US008318256B2

(12) United States Patent
Ishii et al.

(10) Patent No.: US 8,318,256 B2
(45) Date of Patent: Nov. 27, 2012

(54) METALLIC MATERIAL AND METHOD OF MANUFACTURING THE SAME

(75) Inventors: Hitoshi Ishii, Kanagawa (JP); Yasuhiko Nagashima, Kanagawa (JP); Ryosuke Kawagoshi, Kanagawa (JP)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 12/868,862

(22) Filed: Aug. 26, 2010

(65) Prior Publication Data

US 2011/0076505 A1 Mar. 31, 2011

Related U.S. Application Data

(63) Continuation of application No. PCT/JP2009/053664, filed on Feb. 27, 2009.

(30) Foreign Application Priority Data

Feb. 27, 2008 (JP) ..... 2008-046566

(51) Int. Cl.
*B05D 3/00* (2006.01)

(52) U.S. Cl. ..... 427/372.2; 427/327; 427/328

(58) Field of Classification Search ..... 427/327, 427/328

See application file for complete search history.

(56) References Cited

U.S. PATENT DOCUMENTS

| | | | | |
|---|---|---|---|---|
| 2002/0084002 | A1* | 7/2002 | Hardin et al. | 148/243 |
| 2004/0163736 | A1* | 8/2004 | Matsukawa et al. | 148/247 |
| 2004/0170840 | A1* | 9/2004 | Matsukawa et al. | 428/422.8 |
| 2004/0185261 | A1* | 9/2004 | Umino et al. | 428/418 |
| 2004/0244874 | A1 | 12/2004 | Nakayama et al. | |
| 2005/0022908 | A1* | 2/2005 | Tounaka et al. | 148/248 |
| 2005/0103229 | A1* | 5/2005 | Tanaka et al. | 106/162.2 |
| 2007/0031689 | A1* | 2/2007 | Tanaka et al. | 428/469 |
| 2008/0280046 | A1* | 11/2008 | Bryden et al. | 427/327 |

FOREIGN PATENT DOCUMENTS

| | | |
|---|---|---|
| EP | 0048622 | 3/1982 |
| JP | 2003-213456 | 7/2003 |
| JP | 2004-218070 | 8/2004 |
| JP | 2004-218071 | 8/2004 |
| JP | 2005-264230 | 9/2004 |

OTHER PUBLICATIONS

International Search Report for PCT/JP2009/053664, dated Mar. 24, 2009, 4 pages.

European Search Report for EP09721956, dated Apr. 2, 2012, 6 pages.

* cited by examiner

*Primary Examiner* — David Turocy
(74) *Attorney, Agent, or Firm* — Mary K. Cameron

(57) ABSTRACT

A metallic material is provided that is superior to an iron-based metallic material in all of adhesion, heat resistance, electrical conductivity, and corrosion resistance, and a method of manufacturing the metallic material is also provided. A metallic material is provided that includes an iron-based metallic material and an oxide layer formed on the surface of the iron-based metallic material. The oxide layer includes Fe and at least one kind of metal (A) selected from a group consisting of Zr, Ti, and Hf. There is also provided a method of manufacturing the metallic material.

14 Claims, 3 Drawing Sheets

C 1s

O 1s

F 1s

Zr 3d

Fe 2p3/2

Si 2p

Mn 2p3/2

METALLIC MATERIAL AND METHOD OF MANUFACTURING THE SAME

TECHNICAL FIELD

The present invention relates to a metallic material that has excellent corrosion resistance and adhesion in severe environments, and to a method of manufacturing the metallic material.

BACKGROUND ART

Because an iron-based metallic material, particularly typified by carbon steel, has high strength and hardness, and is more inexpensive than other metal, it is most commonly used.

An iron-based metallic material is inferior to chrome, nickel, and cobalt in terms of corrosion resistance and heat resistance. Accordingly, an iron-based metallic material is likely to have a problem in durability due to the occurrence of rust or the growth of an oxide film.

For this reason, an iron-based metallic material that is coated with a resin or provided with a lining has generally been used.

However, to make the most of the heat resistance, abrasion resistance, and electrical conductivity (antistatic property) of iron itself, the problems of corrosion and abrasion resistance, and electrical conductivity and the like needed to be solved.

Meanwhile, stainless steel in which chrome, nickel or molybdenum and the like is alloyed has been commonly used in applications not amenable to a resin coating or a lining.

With resource prices rising in recent years, however, there are an increasing number of cases in which it is difficult to use these alloys, due to reasons of economy.

In addition to phosphate treatment, treatment using a chromic acid has been effective as conventional art for compensating for problems with corrosion resistance, heat resistance, adhesion, and the like in an iron-based metallic material.

In recent years, however, worldwide environmental regulations have made the use a chromic acid difficult.

In response to these circumstances, a method of performing a post-treatment of a phosphate coating, in which steel or a galvanized steel plate is dipped in a solution of a silane coupling agent after phosphate treatment in a step for phosphate treatment of a galvanized steel plate or steel was disclosed in Patent Document 1.

Additionally, Patent Document 2 discloses a metal surface treatment method of performing film chemical conversion using a phosphate aqueous solution on the surface of a steel plate, a zinc or zinc alloy plated steel plate, aluminum or an aluminum alloy, performing electrodeposition coating and performing treatment before the electrodeposition coating and after the film chemical conversion, using an aqueous solution that includes 1 to 100 ppm of Cu ions and that has a pH of 1 to 4.

Further, the applicant has proposed, and disclosed in Patent Document 3, a composition for post-treatment of a chemical conversion film including water, (A) a fluorometal acid anion that includes 4 or more atoms of F, 1 or more atoms of an atom selected from Ti, Zr, Hf, Si, Al, and B, 1 or more atom of an ionizable hydrogen as a selective component and/or 1 or more atom of oxygen, (B) a divalent or quadrivalent cation selected from Co, Mg, Mn, Zn, Ni, Sn, Cu, Zr, Fe, and Sr, (C) one or both of an inorganic oxyanion containing P and a phosphonate anion, and (D) a water-soluble and/or water dispersible organic polymer and/or a polymer-generating resin.

By any one of the above-noted methods, however, although the corrosion resistance and adhesion improved after coating with a zinc phosphate treatment film, the heat resistance and film adhesion was not achieved.

In a method proposed in Patent Document 4 for improving adhesion during coating by coating a metallic material, powder coating is performed after a metallic material, the surface of which has been treated with a phosphate treatment solution, is treated by using an aqueous solution containing a component consisting of one or more kinds of phenol compound derivatives having an average degree of polymerization of 2 to 50 of one or more kinds of polymerization units represented by a general formula (I), and is dried.

However, as long as a zinc phosphate treatment film is used for foundation layer treatment prior to coating, it is impossible to avoid the destruction of the film that is caused by a dehydration reaction from the crystal of a zinc phosphate film at the time of high-temperature baking, and it has not been possible to eliminate a basic cause related to heat resistance.

Moreover, although there is no language to this effect in Patent Document 4, if the above-noted method is applied to a solid lubrication coating, because the surface of a coated film is under high surface pressure, high loading, and high temperature in the environment of use after coating, breaking of the crystal of the zinc phosphate film, which is the foundation layer, occurs, and peeling away of the film might occur.

As long as a zinc phosphate treatment is used as described above, the problem of heat resistance is unavoidable.

Given the above, if the coated film is to be exposed to a high temperature during the baking of the coating or in the environment in which it is used after coating, an iron phosphate film treatment is generally employed as a foundation layer treatment prior to coating. Because it is an amorphous material, an iron phosphate film is superior in heat resistance to a zinc phosphate film. For this reason, an iron phosphate film is widely used.

However, the heat resistance and acid resistance of the iron phosphate film at a high temperature is also insufficient, and the corrosion resistance of the iron phosphate film after coating is significantly lower than that of a zinc phosphate film. For this reason, the iron phosphate film might could not withstand a severely corrosive environment.

Further, the crystals of the phosphate calcium film are also superior to the crystals of a zinc phosphate film in terms of heat resistance, and the crystals of a manganese phosphate film have excellent mechanical strength.

However, all of the cited methods are inferior to a zinc phosphate treatment as a foundation layer treatment prior to coating in terms of corrosion resistance, and there is room for improvement in terms of adhesion. Furthermore, because the film is inferior in terms of electrical conductivity, use was not possible in batteries, in electrical components, or in applications requiring an antistatic property.

Up until now, no practical metallic material wherein a metal oxide different from an underlying metal has excellent corrosion resistance and adhesion even in severe environments, such as at the high temperatures as described above, and wherein a film having electrical conductivity is formed, and a method of manufacturing the metallic material have been discovered.

Meanwhile, specific metal oxides, such as a zirconium oxide or a titanium oxide, have very superior heat resistance and chemical resistance.

The applicant has proposed (see Patent Documents 5 and 6) a composition for the surface treatment of a metal, containing a compound that contains at least one kind of metal element selected from the above-noted Ti, Zr, Hf, and Si and a compound that contains at least one element selected from Ag, Al, Cu, Fe, Mn, Mg, Ni, Co, and Zn.

Patent Document 1: Japanese Laid-Open Patent Application (JP-A) No. 52-80239

Patent Document 2: Japanese Laid-Open Patent Application JP-A No. 7-150393

Patent Document 3: Japanese Laid-Open Patent Application JP-A No. 11-6077

Patent Document 4: Japanese Laid-Open Patent Application JP-A No. 2001-9365

Patent Document 5: Pamphlet of International Publication No. 2002/103080

Patent Document 6: Japanese Laid-Open Patent Application JP-A No. 2005-264230

DISCLOSURE OF THE INVENTION

Problems to be Solved by the Invention

In the progress of research, the inventors found, with regard to a metal surface treating composition containing compounds such as a compound containing at least one kind of metal element selected from Ti, Zr, Hf, and Si and a compound that contains at least one element selected from Ag, Al, Cu, Fe, Mn, Mg, Ni, Co, and Zn, that there is not necessarily sufficient adhesion between an underlying metal such as iron or the like and a dissimilar metal oxide film, such as $ZrO_2$ formed on the surface thereof. The matching of atoms between the metal base material and a dissimilar metal oxide being poor is thought to be the reason for this.

Accordingly, the present invention has been made to solve the above-noted problem in the conventional art, and an object of the present invention is to provide a metallic material that is superior to an iron-based metallic material in all properties of adhesion, heat resistance, electrical conductivity, and corrosion resistance, and a method of manufacturing the metallic material.

Means for Solving the Problems

Further, as the result of active research aimed at achieving the above-noted object, the inventors found that a metallic material that includes an iron-based metallic material and an oxide layer that is formed on the surface of the iron-based metallic material as an inorganic film, wherein the oxide layer includes Fe and at least one kind of metal (A) selected from a group consisting of Zr, Ti, and Hf as oxides, is superior in all the properties of adhesion, heat resistance, electrical conductivity, and corrosion resistance.

Furthermore, the inventors found a method of manufacturing the above-noted metallic material, thereby completing the present invention.

Specifically, the present invention provides the following (1) to (17).

(1) A metallic material that includes an iron-based metallic material and an oxide layer formed on the surface of the iron-based metallic material, wherein the oxide layer includes Fe and at least one kind of metal (A) selected from a group consisting of Zr, Ti, and Hf.

(2) The metallic material according to the above-noted (1), wherein the oxide layer includes an upper layer that includes a metal (A) oxide of at least one kind of metal (A) selected from a group consisting of Zr, Ti, and Hf, and a lower layer that includes at least an iron oxide.

(3) The metallic material according to either the above-noted (1) or (2), wherein the oxide includes at least one kind of iron oxide selected from a group consisting of $\gamma$-$Fe_2O_3$, $\alpha$-$Fe_2O_3$, and $Fe_3O_4$.

(4) The metallic material according to any one of the above-noted (1) to (3), wherein the oxide layer includes 2 to 30 atom % of the Fe.

(5) The metallic material according to any one of the above-noted (2) to (4), wherein the thickness of the lower layer is in the range of 0.02 to 0.5 μm.

(6) The metallic material according to any one of the above-noted (1) to (5), wherein the amount of the metal (A) included in the oxide layer is in the range of 10 to 1000 mg/$m^2$ as the total amount expressed in terms of $AO_2$.

(7) The metallic material according to any one of the above-noted (1) to (6), wherein the contact resistance of the oxide layer is 200Ω or less.

(8) The metallic material according to any one of the above-noted (1) to (7), further including a coating layer that is formed on the oxide layer using a ceramic or a resin.

(9) A method of manufacturing a metallic material including a metal (A) oxide adhesion step of applying or electrodepositing a metal (A) oxide of at least one kind of metal (A) selected from a group consisting of Zr, Ti, and Hf or a precursor thereof to the surface of an iron-based metallic material so as to convert the iron-based metallic material into an iron-based metallic material that includes a metal (A) oxide film, and an oxidation treatment step of manufacturing the metallic material according to any one of the above-noted (1) to (8) by heating the iron-based metallic material that includes the metal (A) oxide film.

(10) The method according to the above-noted (9), further including, after the oxidation treatment step, a coating step of providing a ceramic or a resin on the oxide layer of the metallic material.

(11) A method of manufacturing a metallic material including a chemical conversion treatment step of manufacturing the metallic material according to any one of above-noted (1) to (8) by making an iron-based metallic material come into contact with an acid aqueous solution that includes metal (A) ions of at least one kind of metal (A) selected from a group consisting of Zr, Ti, and Hf, 30 ppm or more of Fe ions, and oxidant ions.

(12) The method according to the above-noted (11), wherein the acid aqueous solution further includes an amorphous hydroxide of at least one kind of metal (A) selected from a group consisting of Zr, Ti, and Hf.

(13) The method according to the above-noted (11) or (12) further including, after the chemical conversion treatment step, an oxidation treatment step of heating the metallic material.

(14) The method according to the above-noted (13) further including, after the oxidation treatment step, a coating step of providing a coating layer, which is made of a ceramic or a resin, on the oxide layer of the metallic material.

(15) The method according to any one of the above-noted (11) to (14), wherein the acid aqueous solution further includes fluorine.

(16) The method according to any one of the above-noted (11) to (15), wherein the acid aqueous solution further includes a water-soluble organic compound.

(17) The method according to any one of the above-noted (9) to (16), wherein the iron-based metallic material is stainless steel.

Further, the inventors found that a metallic material that includes an iron-based metallic material and an oxide layer that is formed on the surface of the iron-based metallic material, wherein the oxide layer includes Fe and at least one kind of metal (A) selected from a group consisting of Zr, Ti, and Hf as oxides has superior adhesion to an adhesive, a primer, and a paint.

Effects of the Invention

The metallic material according to the present invention has excellent adhesion, corrosion resistance, heat resistance, and electrical conductivity.

According to the method of manufacturing a metallic material of the present invention, it is possible to manufacture a metallic material that has excellent adhesion, corrosion resistance, heat resistance, and electrical conductivity.

REFERENCE NUMERALS

Figure 1:
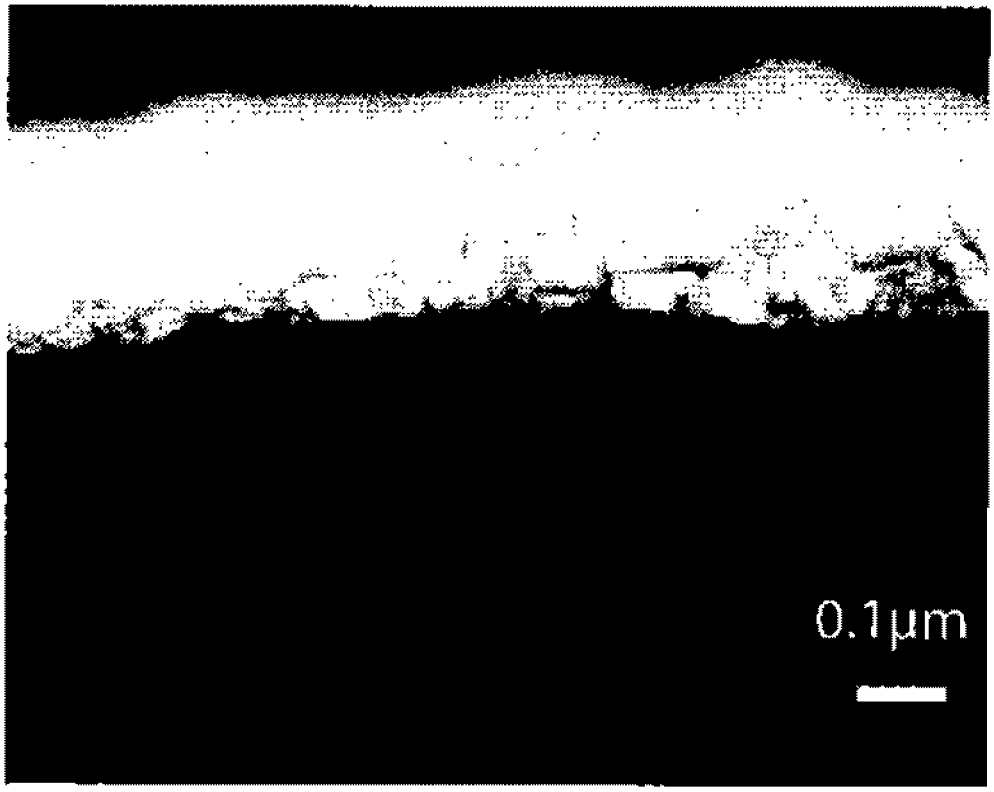
FIG. 1 is a photograph of a cross-section of an example of a metallic material according to the present invention taken by a transmission-type electron microscope.
Figure 2A:
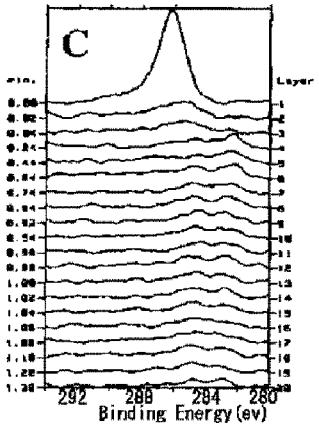
FIGS. 2A-2G are a series of graphs showing an XPS narrow spectrum obtained from the result of an analysis performed using XPS (X-ray photoelectron spectroscopy) of each element contained in an oxide layer of an example of the metallic material according to the present invention.
Figure 2B:
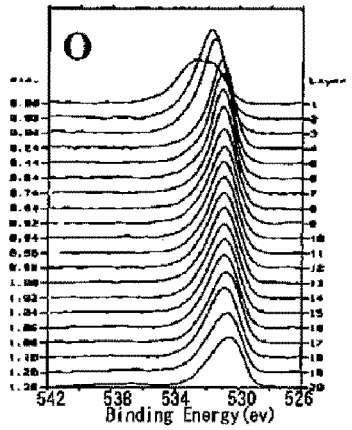
Figure 2C:
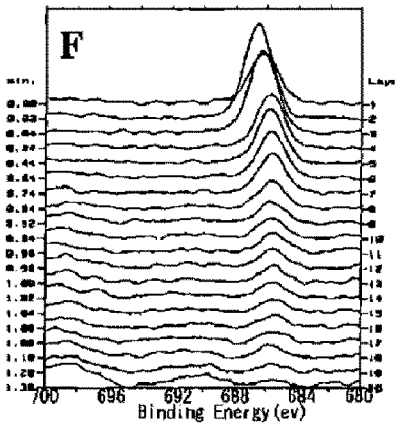
Figure 2D:
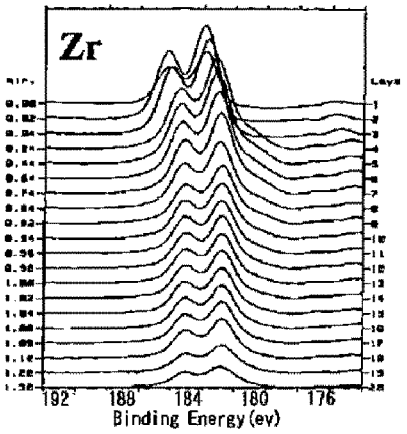
Figure 2E:
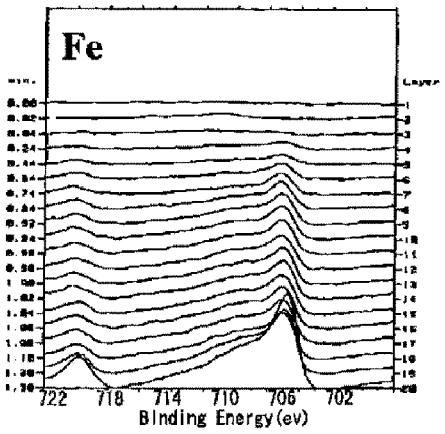
Figure 2F:
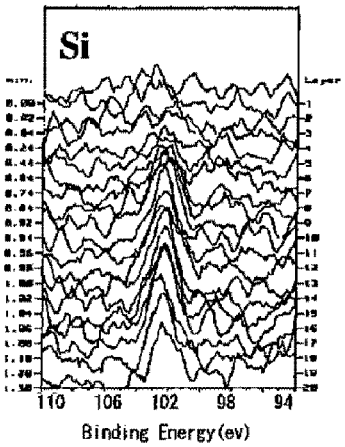
Figure 2G:
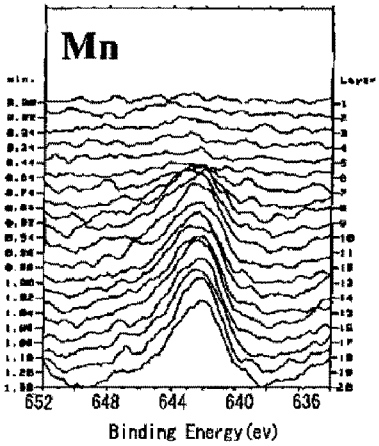

1: Metallic material
2: Iron-based metallic material
3: Oxide layer
4: Upper layer
5: Lower layer

BEST MODE FOR CARRYING OUT THE INVENTION

The present invention is described in detail below.

A metallic material according to the present invention is described first.

The metallic material according to the present invention includes an iron-based metallic material and an oxide layer formed on the surface of the iron-based metallic material, the oxide layer containing Fe and at least one kind of metal (A) selected from a group consisting of Zr, Ti, and Hf as oxides.

The iron-based metallic material is described below.

The iron-based metallic material is not particularly limited, as long as the iron-based metallic material used in the metallic material according to the invention contains iron.

Examples of the iron-based metallic material include pure iron, carbon steel, cast iron, alloy steel, and stainless steel.

From the standpoint of excellent heat resistance, the iron-based metallic material is preferably stainless steel and more preferably ferritic stainless steel.

Examples of the form of the iron-based metallic material include steel plates such as a cold-rolled steel plate and a hot-rolled steel plate, a steel bar, shape steel, a steel strip, a steel pipe, a wire rod, a cast or forged product, and bearing steel and the like.

In the present invention, a surface-treated iron-based metallic material may be used as the iron-based metallic material.

The method of treating the surface of the iron-based metallic material is not particularly limited. For example, in a pretreatment step for forming an oxide layer, it is possible to perform pretreatment in which, after degreasing an iron-based metallic material with an alkaline degreasing solution, rinsing the iron-based metallic material with water, and performing treatment of the iron-based metallic material to roughen the surface thereof using an etchant, pretreatment that peels away the film is performed and chemical conversion treatment is performed using a phosphate such as a manganese phosphate-based surface treating agent, after which the film is peeled away.

Further, in the pretreatment step preceding the step of forming the oxide layer, adhesion can be further improved by further adding a step of roughening the surface of the iron-based metallic material by a physical or chemical method. Methods of physically roughening the surface of the iron-based metallic material include sandblasting, shotblasting, wet blasting, electromagnetic barrel polishing, WPC treatment, and the like, any one of which may be used. In the case of a member vulnerable to an impact or in order to enhance mass production capability, a chemical method of roughening the surface of the iron-based metallic material is preferable, and a method of forming a polycrystalline film, such as phosphate or oxalate, by a chemical conversion treatment or anode electrolysis and peeling off the film with a peeling solution such as a hydrochloric acid or nitric acid is preferable. In this case, in the formation of the film, a more preferable method is that of forming a film and etching holes by treating a material containing phosphate ions and metal ions such as zinc ions, manganese ions, nickel ions, cobalt ions, and calcium ions and also of which the pH of an aqueous solution thereof is adjusted in the range of 1 to 5, as a film treatment solution at a temperature of 40 to 100° C., and then peeling off the film with the acid solution. If the iron-based metallic material (base material) is stainless steel, it is preferable to remove the film and smut with an acid after the iron-based metallic material is treated with a solution containing ferric chloride or an oxalic acid.

A single iron-based metallic material may be used alone or two or more kinds of iron-based metallic materials may be used in combination. The oxide layer is described below.

The oxide layer of the metallic material according to the present invention is formed on the surface of the iron-based metallic material, and contains Fe and at least one kind of metal (A) selected from a group consisting of Zr, Ti, and Hf as oxides.

As long as the oxide layer of the metallic material according to the present invention contains Fe and at least one kind of metal (A) selected from a group consisting of Zr, Ti, and Hf as oxides, the oxide layer is not particularly limited.

In the present invention, the oxide includes, in addition to an oxidized metal, a hydroxide and a compound oxide.

For example, there are the cases of (1) the oxide layer containing Fe and at least one kind of metal (A) selected from a group consisting of Zr, Ti, and Hf, and metal (A) and Fe may coexist with each other as oxides (for example, as at least one selected from a group consisting of a compound oxide, oxidized metal, and a hydroxide) in substantially the same layer, and (2) the oxide layer including an upper layer that contains at least metal (A) oxide of one kind of metal (A) selected from a group consisting of Zr, Ti, and Hf; and a lower layer that contains at least an iron oxide.

If the oxide layer includes upper and lower layers, the upper layer may substantially not include Fe.

Fe as an oxide is described below.

The oxide layer of the metallic material according to the present invention needs to contain Fe as an oxide.

In the present invention, Fe as an oxide (hereinafter, referred to as an "iron oxide") includes, in addition to an iron oxide, a compound oxide of at least one kind of metal (A) selected from a hydroxide, Zr, Ti, and Hf.

From the standpoint of chemical stability, it is preferable that Fe exists in the oxide layer as divalent or trivalent Fe.

Examples of the iron oxide include iron oxides such as FeO, $Fe_2O_3$, $\gamma$-$Fe_2O_3$, $\alpha$-$Fe_2O_3$, and $Fe_3O_4$, Fe hydroxides such as $Fe(OH)_2$ and $Fe(OH)_3$, and a compound oxide of at least one kind of metal (A) selected from Zr, Ti, and Hf, such as $FeTiO_3$, $FeZrO_3$, and $FeHfO_3$.

From the standpoint of superior heat resistance, adhesion, and electrical conductivity, Fe is preferably as an iron oxide, and more preferably as $\gamma$-$Fe_2O_3$, $\alpha$-$Fe_2O_3$, or $Fe_3O_4$.

The iron oxide prevents the transformation of the crystals of the metal (A), and has the effect of not only improving high-temperature stability and adhesion, but also imparting heat resistance and electrical conductivity to the film, and reducing the contact resistance. If electrical conductivity is imparted to the film, the electron conductivity between the film and a material joined thereto is improved, so that the static electricity grounding property is improved, and when used as a fuel cell member, the iron oxide has the effect of improving current-carrying performance. For this reason, it is preferable that electrical conductivity be imparted to the film.

The metal (A) as an oxide is described below

The oxide layer of the metallic material according to the present invention contains at least one kind of metal (A) selected from Zr, Ti, and Hf.

In the present invention, at least one kind of metal (A) selected from Zr, Ti, and Hf as the oxide includes, in addition to the oxidized metal (A), a hydroxide and a compound oxide of Fe.

Hereinafter, the metal (A) as an oxide will be referred to as a "metal (A) oxide."

From the standpoint of superior electrical conductivity, it is preferable that the at least one kind of metal (A) selected from Zr, Ti, and Hf be Ti.

Examples of a metal (A) oxide of at least one kind of metal (A) selected from Zr, Ti, and Hf include an oxidized metal (A) such as $TiO_2$, $ZrO_2$, and $HfO_2$, metal (A) hydroxides, such as $Ti(OH)_2$, $Zr(OH)_2$, and $Hf(OH)_2$, and a compound oxide of Fe. Specific examples of the compound oxide of Fe are the same as noted above.

The composition of the oxide layer includes, for example, mixed hydroxides such as $Zr(OH)_4$, $Ti(OH)_4$ or $Hf(OH)_4$ and $Fe(OH)_3$; crystalline compound oxides such as $FeTiO_3$, and $FeZrO_3$; mixed oxides such as of $ZrO_2$, $TiO_2$, or $HfO_2$ with $Fe_2O_3$ or $Fe_3O_4$; and a combination thereof.

From the standpoint of superior adhesion and heat resistance, it is preferable that the oxide layer be a dense crystalline material.

In the oxide layer, from the standpoint of superior adhesion and heat resistance, the oxide or the compound oxide preferably includes a crystalline oxide and more preferably a crystalline iron oxide.

The crystalline iron oxide can include, for example, $\gamma$-$Fe_2O_3$, $\alpha$-$Fe_2O_3$, and $Fe_3O_4$.

Because the iron oxide improves corrosion resistance and heat resistance and has excellent crystal lattice matching between an iron-based metallic material (iron-base material) and an oxide, the iron oxide has excellent adhesion between the iron-based metallic material and itself.

Additionally, since the iron oxide forms minute concavities and convexities, the iron oxide also has excellent adhesive property between the metal (A) oxide and itself, due to an anchor effect.

The oxide layer may contain an amorphous component. The amorphous component or the hydroxide of the oxide layer is preferable because it is gradually crystallized and made dense by being heated in the environment of use or by an oxidation treatment step when the metallic material according to the present invention is manufactured.

Particularly, from the standpoint of superior adhesion, heat resistance, and electrical conductivity and of excellent adhesion to an adhesive or a primer, the oxide layer preferably contains 2 to 30 atom % of Fe and more preferably contains 3 to 10 atom % of Fe.

If the amount of Fe is 30 atom % or less, the oxide layer has excellent chemical resistance.

It is possible to measure the Fe content of the oxide layer at each depth of the film by surface analysis that is performed using XPS (X-ray photoelectron spectroscopy).

From the standpoint of superior heat resistance and electrical conductivity and excellent adhesion to an adhesive or a primer, the thickness of the oxide layer is preferably in the range of 0.02 to 2 μm and more preferably in the range of 0.05 to 1 μm.

In the present invention, the thickness of the oxide layer means the average value of the thickness of the oxide layer.

In the present invention, a photograph of the cross-section of the metallic material was taken using a transmission-type electron microscope, and the thickness (average value) of the oxide layer was taken as the average measured value at 10 locations in the photograph, which were positioned at intervals of 0.1 μm on the surface of the iron-based metallic material.

Further, from the standpoint of superior adhesion, heat resistance, and electrical conductivity and of excellent adhesion to an adhesive or a primer, the amount of Fe at a portion where the depth from the surface of the oxide layer is 0.01 μm is preferably in the range of 1 to 5 atom % and more preferably in the range of 2 to 4 atom %.

From the standpoint of superior adhesion, heat resistance, and electrical conductivity and of excellent adhesion to an adhesive or a primer, it is preferable that the oxide layer of the metallic material according to the present invention include an upper layer containing at least metal (A) oxide of one kind of metal (A) selected from a group consisting of Zr, Ti, and Hf and a lower layer containing at least an iron oxide.

The above-noted lower layer is positioned between the upper layer and the iron-based metallic material in this case.

As long as the upper layer of the oxide layer contains at least a metal (A) oxide of at least one kind of metal (A) selected from a group consisting of Zr, Ti, and Hf, the upper layer is not particularly limited. The metal (A) oxide means the same as noted above.

One metal (A) oxide may be used alone or two or more kinds of metal (A) oxides may be used in combination.

From the standpoint of superior adhesion, heat resistance, and electrical conductivity and of excellent adhesion to an adhesive or a primer, the thickness of the upper layer is preferably in the range of 0.02 to 2 μm and more preferably in the range of 0.05 to 1 μm.

In the present invention, the thickness of the upper layer means an average value of the thickness of the upper layer.

In the present invention, a photograph of the metallic material was taken using a transmission-type electron microscope, and the thickness (average value) of the upper layer was taken as the average measured value at 10 locations in the photograph, which were positioned at intervals of 0.1 μm on the surface of the iron-based metallic material.

The method of measuring the thickness (average value) of the lower layer was the same as the method of measuring the thickness of the upper layer.

As long as the lower layer of the oxide layer contains an iron oxide, the lower layer is not particularly limited.

It is possible to further improve corrosion resistance and adhesion by the iron oxide that is contained in the lower layer.

The iron oxide as used herein has the same meaning as noted above.

From the standpoint of superior adhesion, heat resistance, and electrical conductivity, it is preferable that the lower layer (iron oxide layer) be a crystalline iron oxide. It is possible to judge the crystallinity or structure of the oxide layer (oxide film) by a cross-sectional TEM method or an X-ray diffraction method.

The kind of the crystalline iron oxide is not particularly limited, and the crystalline iron oxide may be a compound oxide containing another metal.

From the standpoint of superior adhesion, heat resistance, and electrical conductivity $\gamma$-$Fe_2O_3$, $\alpha$-$Fe_2O_3$, $Fe_3O_4$, and the like are preferable.

Because the iron oxide improves corrosion resistance and heat resistance and has excellent crystal lattice matching between an iron-based metallic material (iron-based material) and an oxide, the iron oxide has excellent adhesion between the iron-based metallic material and itself.

Additionally, since the crystalline iron oxide forms minute concavities and convexities on the surface of the iron-based metallic material, the crystalline iron oxide also has excellent adhesive property between the metal (A) oxide and itself, due to an anchor effect.

One iron oxide may be used alone or two or more kinds of iron oxides may be used in combination.

The lower layer may be formed of a single layer or two or more layers.

If the oxide layer includes the upper and lower layers, from the standpoint of superior adhesion, heat resistance, and electrical conductivity and of superior adhesion to and adhesive or a primer, the amount of Fe of the lower layer is preferably in the range of 2 to 30 atom % and more preferably in the range of 3 to 10 atom %.

If the oxide layer includes the upper and lower layers, from the standpoint of superior adhesion, heat resistance and electrical conductivity and of superior adhesion to an adhesive or a primer, the amount of Fe at a portion where the depth from the surface of the oxide layer is 0.01 μm is preferably in the range of 1 to 5 atom % and more preferably in the range of 2 to 4 atom %.

In terms of superior adhesion, heat resistance, and electrical conductivity and of excellent adhesion to an adhesive or a primer, the thickness of the lower layer is preferably in the range of 0.02 to 0.5 μm and more preferably in the range of 0.05 to 0.3 μm.

In the present invention, the thickness of the lower layer means an average value of the thickness of the lower layer.

From the standpoint of superior corrosion resistance, heat resistance, adhesion, and of electrical conductivity and high strength of the film, the amount of metal (A) which is contained in the oxide layer of the metallic material according to the present invention is preferably in the range of 10 to 1,000 $mg/m^2$ and more preferably in the range of 30 to 300 $mg/m^2$ as the total amount expressed in terms of $AO_2$.

If the amount of adhering metal (A) is 10 $mg/m^2$ or more as the total amount expressed in terms of $AO_2$, the film has superior corrosion resistance and heat resistance. Also, if the amount of adhering metal is approximately 1,000 $mg/m^2$ or less, cracking is difficult to occur in the film, and the strength of the film is high.

If an iron oxide exists in the oxide layer of the metallic material according to the present invention, the metallic material has excellent heat resistance and adhesion, and the electrical conductivity thereof is increased.

From the standpoint of superior heat resistance, adhesion, and electrical conductivity, it is preferable that the iron oxide of the metallic material according to the present invention exist as a crystalline iron oxide, such as $\gamma$-$Fe_2O_3$, $\alpha$-$Fe_2O_3$, or $Fe_3O_4$, between the iron-based metallic material (base material metal) and the upper layer (metal (A) oxide layer).

It is possible to confirm the existence of the iron oxide by X-ray diffraction, a transmission-type electron microscope, or GDS and the like.

It is preferable that the contact resistance of the oxide layer of the metallic material according to the present invention be 200Ω or less.

If the oxide layer contains an iron oxide and the amount of adhering metal (A) is 1,000 $mg/m^2$ or less as the total amount expressed in terms of $AO_2$, it is possible to achieve a value of low contact resistance of about 200Ω or less for the oxide layer.

It is possible to measure the value of contact resistance using a commercially available surface resistance meter that is compliant to JIS K 7194:1994 (for example, type MCP-T360 [two-point type] manufactured by Mitsubishi Chemical Corporation).

If the contact resistance is low, the metallic material may be used for members that require an antistatic property, such as in a current-carrying member such as a battery contact or a material of a fuel cell, as a foundation for lubrication painting, in various machines, and in automobiles.

The metallic material according to the present invention may further include a coating layer that is formed on the oxide layer and is made of a ceramic or a resin.

If a coating layer made of a ceramic or a resin is provided on the surface of the oxide layer, it is possible to further improve the corrosion resistance of the metallic material or the adhesion of the metallic material can be improved when the metallic material is joined to other members.

It is preferable that the formation of the coating layer made of a ceramic or a resin be done by applying a liquid or paste-like curable primer or adhesive containing organic or inorganic film components.

It is preferable that an organic resin and an elastomer be used as an organic material, and it is also preferable that a material obtaining by adding a silane-coupling agent to the organic resin and elastomer be used as an organic material.

The organic material is not limited to the organic resin and the elastomer. Examples of the organic material include rubber, synthetic rubber, an epoxy resin, a phenol resin, a silicone resin, a polyamide resin, a polyimide resin, a fluorine resin, a polyester resin, a polyether resin, an ABS resin, a melamine resin, a PPS resin, a PEEK resin, a vinyl chloride resin, an acrylic resin, and an electrically conductive polymer.

An epoxy resin type, a phenol resin type, a polyimide resin type, a polyamide resin type, and a silicone resin type are particularly preferable from the standpoint of superior heat resistance and adhesion.

For example, it is preferable that the silane-coupling agent, which can be contained in the organic material, have as a functional group any one of a vinyl group, an epoxy group, a methacryl group, an amino group, and a mercapto group, and a material obtained by polymerizing these monomers or a material obtained by mixing these monomers in the resin can be used as the silane-coupling agent.

For example, a metal alkoxide type (sol-gel type), a water glass type, a phosphate type, a peroxo compound type, or a polysilazane type, and the like can be used as an inorganic primer or an adhesive, and it is more preferable that any one of Zr, Ti, Al, Si, and B be contained in the component.

From the standpoint of superior electrical conductivity, it is preferable that the coating layer made of a ceramic or a resin further contains electrically conductive particles.

It is preferable that, for example, nickel, stainless steel, antimony, zinc, aluminum, graphite particles, carbon fiber, carbon nanotubes, a zinc oxide, a tin oxide, ITO, or lanthanum chromite be used as the electrically conductive particles.

The manufacture of the metallic material according to the present invention is not particularly limited.

For example, the metallic material may be manufactured by the following film forming methods described in (1) to (3).

(1) Application method+oxidation treatment method, whereby a metal (A) oxide of at least one kind of metal (A) selected from Zr, Ti, and Hf or a precursor thereof is applied to the surface of an iron-based metallic material, and the iron-based metallic material is oxidized after drying.

(2) Electrolysis method of electrolyzing a metallic material in a metal (A) oxide dispersion liquid or a precursor solution thereof.

(3) Reaction method (chemical conversion treatment method), whereby a film is deposited and formed by making an iron-based metallic material come into contact with and react with an acid aqueous solution that contains metal (A) ions, Fe ions, and oxidant ions.

In the chemical conversion treatment method of (3), it is preferable that oxidation treatment, such as heating of the metallic material in an oxidizing atmosphere, be performed after the metallic material is further rinsed with water and dried.

If the oxide layer of the metallic material according to the present invention includes an upper layer and a lower layer (iron oxide layer), examples of the manufacturing method thereof include a chemical conversion treatment method and an oxidation treatment method of performing an oxidation treatment such as heating oxidation after forming a film. A metallic material having excellent corrosion resistance, adhesion, electrical conductivity, and heat resistance can be manufactured by these treatments.

Specifically, the metallic material may be manufactured by, for example, the following film-forming methods described in (1) to (4).

(1) Application method+oxidation treatment method, whereby a metal (A) oxide of at least one kind of metal (A) selected from Zr, Ti, and Hf or a precursor thereof is applied to the surface of an iron-based metallic material, and the iron-based metallic material is oxidized after drying.

(2) Electrolysis method+oxidation treatment method, whereby a metallic material in metal (A) oxide dispersion liquid or a precursor solution thereof is electrolyzed, and the metallic material is oxidized after drying.

(3) Reaction method (chemical conversion treatment method), whereby a film is deposited and formed by making an iron-based metallic material come into contact with and react with an acid aqueous solution that contains metal (A) ions, Fe ions, and oxidant ions.

(4) Chemical conversion treatment method+oxidation treatment method, whereby the chemical conversion treatment method of (3) is performed, after which the metallic material is rinsed with water, and oxidizing such as heating the metallic material in an oxidation atmosphere is performed after drying.

The oxidation treatment method can be performed prior to the application method, the electrolytic method, and the chemical conversion treatment method.

For example, a method of heating a material in an air atmosphere at a high temperature of 200° C. or more, a method of heating a material in a strong alkaline aqueous solution containing an oxidant, or a method of treating a material in a fused salt bath having oxidation at a temperature of 400° C. or more can be used as the oxidation treatment method.

If the oxidation treatment method is used, it is possible to efficiently form on the iron-based metallic material a layer that contains an iron oxide.

If the metallic material according to the present invention includes a coating layer, the manufacture thereof is not particularly limited. For example, a method may be used that includes applying to the oxide layer of the metallic material at least one selected from a group consisting of primer, a curable primer, and an adhesive, forming a coating layer by heating and hardening the applied material; and making the coating layer (the layer made of a primer, a curable primer, or an adhesive) adhere to the oxide layer.

The method of using the metallic material according to the present invention is not particularly limited. For example, a highly corrosion resistant coating, a lubrication coating, a lining, a ceramic coating, or a resin coating can be applied to the metallic material according to the present invention.

Since the metallic material according to the present invention can exhibit excellent performance and durability even as an organic/inorganic adhesion foundation layer, the practical value of the metallic material is high.

The use of the metallic material according to the present invention is not particularly limited.

The metallic material according to the present invention maintains corrosion resistance, adhesion, and electrical conductivity of the iron-based metallic material in environments even more severe than the case of the conventional art.

The metallic material according to the present invention may be used for members that require an antistatic property, for example, a sliding member or a heat-resistant member of an industrial machine, a transport machine, or a conveying apparatus, for a current-carrying member, that is, a battery member such as a battery contact, a separator, a current collector, a fuel cell member such as an electrode, a material of a fuel cell, or the like, a foundation layer for lubrication coating, and in various machines and in automobiles. The fuel cell includes, for example, a fuel cell for an automobile, a fuel cell for home use, a fuel cell for commercial use, a stationary fuel cell, and a fuel cell for a mobile device.

The oxide layer of the metallic material according to the present invention is resistant to immersion in an acid or an alkali and is chemically stable.

In an actual metal-corrosive environment, a decrease of pH occurs at an anode part where the elution of metal occurs, and an increase of pH occurs at a cathode part where a reduction reaction occurs. For this reason, a surface treatment film having less acid resistance and alkali resistance would be dissolved in a corrosive environment, so that the effect of the surface treatment film is lost.

In contrast, because the oxide layer of the metallic material according to the present invention is resistant to an acid or an alkali, the oxide layer of the metallic material according to the present invention maintains an excellent effect even in a corrosive environment.

A method of manufacturing the metallic material according to the present invention is described below.

The method of manufacturing the metallic material according to the present invention includes:

a metal (A) oxide adhesion step of applying or electrodepositing a metal (A) oxide of at least one kind of metal (A)

selected from a group consisting of Zr, Ti, and Hf or a precursor thereof to the surface of an iron-based metallic material so as to convert the iron-based metallic material to an iron-based metallic material that includes a metal (A) oxide film; and an oxidation treatment step of manufacturing the metallic material according to the present invention by heating the iron-based metallic material including the metal (A) oxide film.

Hereinafter, the above is referred to as a "method of manufacturing a metallic material according to a first aspect of the present invention."

The metal (A) oxide adhesion step is described below.

In the method of manufacturing a metallic material according to the first aspect of the present invention, the metal (A) oxide adhesion step is a step of applying or electrodepositing a metal (A) oxide of at least one kind of metal (A) selected from a group consisting of Zr, Ti, and Hf or a precursor thereof onto the surface of an iron-based metallic material so as to convert the iron-based metallic material into an iron-based metallic material that includes a metal (A) oxide film.

The iron-based metallic material used in the metal (A) oxide adhesion step is not particularly limited. For example, the same materials as noted above may be used.

From the standpoint of superior corrosion resistance, it is preferable that the iron-based metallic material be stainless steel.

For example, in a pretreatment step for forming an oxide layer, it is possible to perform pretreatment in which, after degreasing an iron-based metallic material with an alkaline degreasing solution, rinsing the iron-based metallic material with water, and performing treatment of the iron-based metallic material to roughen the surface thereof using an etchant, pretreatment that peels away the film is performed and chemical conversion treatment is performed using a phosphate such as a manganese phosphate-based surface treating agent, after which the film is peeled away.

Further, in the pretreatment step preceding the step of forming the oxide layer, adhesion may be further improved by further adding a step of roughening the surface of the iron-based metallic material by a physical or chemical method. Methods of physically roughening the surface of the iron-based metallic material include sandblasting, shotblasting, wet blasting, electromagnetic barrel polishing, WPC treatment, and the like, any one of which may be used. In the case of a member vulnerable to an impact or in order to enhance mass production capability, a chemical method of roughening the surface of the iron-based metallic material is preferable, and a method of forming a polycrystalline film, such as phosphate or oxalate, by a chemical conversion treatment or anode electrolysis and peeling off the film with a peeling solution such as a hydrochloric acid or nitric acid is preferable. In this case, in the formation of the film, a more preferable method is that of forming a film and etching holes by treating a material containing phosphate ions and metal ions such as zinc ions, manganese ions, nickel ions, cobalt ions, and calcium ions and also of which the pH of an aqueous solution thereof is adjusted in the range of 1 to 5, as a film treatment solution at a temperature of 40 to 100° C., and then peeling off the film with the acid solution. If the iron-based metallic material (base material) is stainless steel, it is preferable to remove the film and smut with an acid after the iron-based metallic material is treated with a solution containing ferric chloride or an oxalic acid.

Examples of the metal (A) oxide, which is used in the metal (A) oxide adhesion step, of at least one kind of metal (A) selected from Zr, Ti, and Hf include oxidized metal (A) such as $TiO_2$, $ZrO_2$, and $HfO_2$, metal (A) hydroxides such as $Ti(OH)_2$, $Zr(OH)_2$, and $Hf(OH)_2$, and a compound oxide of Fe. Specific examples of the compound oxide of Fe are the same as noted above.

It is preferable that, for example, a crystalline sol, an amorphous sol, and the like be used as the metal (A) oxide. It is preferable that the particle size of the metal (A) oxide be in the range of 1 to 200 nm.

The precursor of the metal (A) oxide, used in the metal (A) oxide adhesion step, of at least one kind of metal (A) selected from Zr, Ti, and Hf is not particularly limited.

It is preferable that, for example, inorganic compounds such as alkoxide, chloride, nitrate, and fluoride of metal (A), a chelate such as an oxalic acid, an acetic acid, a citric acid, a maleic acid, a tartaric acid, a glycolic acid, a lactic acid, and β-diketone, organic salts, or a hydrogen peroxide complex, and the like be used as the precursor (a raw material of a metal compound) of the metal (A) oxide. More preferable examples of the precursor include a basic zirconium carbonate solution, a peroxotitanic acid solution, and a Zr—Hf alkoxide hydrolysate alcohol solution.

The metal (A) oxide or the precursor thereof used in the metal (A) oxide adhesion step can be used as an acid aqueous solution.

The method of applying the metal (A) oxide or the precursor thereof to the surface of the iron-based metallic material in the metal (A) oxide adhesion step is not particularly limited. For example, a well-known method may be used. Specifically, a dipping method or a spin-coating method may be used.

The method of electrodepositing the metal (A) oxide and the precursor thereof onto the surface of the iron-based metallic material in the metal (A) oxide adhesion step is not particularly limited.

In the electrodeposition, the metal (A) oxide or the precursor thereof may be deposited as an oxide onto the surface of the iron-based metallic material by electrolysis, using a voltage of approximately several volts to several tens of volts.

In the case of electrolytic deposition, it is possible to electrodeposit (electrolytically deposit) a metal (A) oxide or a precursor thereof as an oxide onto the surface of the iron-based metallic material by diluting a solution (for example, aqueous solution), which contains a metal (A) oxide or a precursor thereof or a sol of a metal (A) oxide or a precursor thereof and, if necessary, placing the diluted solution into an electrolytic bath, providing insoluble or soluble opposing electrodes, and performing electrolytic treatment.

It is preferable that electrodeposition be performed under conditions of the concentration of the metal (A) being in the range of 0.1 to 5%, the temperature being in the range of 10 to 70° C., and current density being in the range of 0.02 to 5 $A/dm^2$.

If anode electrolysis is used in the electrodeposition, because it is possible to obtain an advantage of further increasing adhesion by introducing Fe, which is contained in the iron-based metallic material (base material), into the metal (A) oxide film as an iron oxide or promoting the formation of the lower layer (iron oxide layer), anode electrolysis is more preferable than cathode electrolysis.

In the metal (A) oxide adhesion step, it is possible to convert the iron-based metallic material into an iron-based metallic material that includes a metal (A) oxide film.

The oxidation treatment step is described below.

The oxidation treatment step of the method of manufacturing a metallic material according to the first aspect of the present invention is for manufacturing the metallic material according to the present invention by heating the iron-based metallic material that includes the metal (A) oxide film.

The heating temperature in the oxidation treatment step is preferably in the range of 100 to 700° C. and more preferably in the range of 200 to 500° C. It is possible to convert the metal (A) oxide into an oxidized metal (A), such $TiO_2$, $ZrO_2$, and $HfO_2$, by heating and drying the metal (A) oxide.

Further, Fe ions are diffused into the oxide layer from the surface of the iron-based metallic material (base material metal) by the oxidation treatment step and an iron oxide layer is formed at the boundary between the iron-based metallic material (base material metal) and the metal (A) oxide film, so that corrosion resistance and adhesion are further improved.

In this case, there is a tendency for the oxide layer to be formed in the form of a multilayer oxide layer that includes an upper layer containing a metal (A) oxide and a lower layer containing an iron oxide.

The oxidation treatment method, which can used to form the lower layer, is not particularly limited. For example, the method used can be a method of heating a material in air at a high temperature of 200° C. or higher after the formation of a metal (A) oxide film, a method of heating a material in a strong alkaline aqueous solution which contains an oxidant, the temperature of is 100° C. or higher, or a method of treating a material in a oxidizing fused salt bath at a temperature of 400° C. or higher.

It is possible to further improve corrosion resistance, adhesion, and heat resistance by the oxidation treatment step.

The kind of the iron oxide that is obtained by the oxidation treatment step is not particularly limited. For example, it is preferable that iron oxides such as $\gamma$-$Fe_2O_3$, $\alpha$-$Fe_2O_3$, and $Fe_3O_4$ be obtained.

It is possible to obtain the metallic material according to the present invention in the oxidation treatment step.

The surface of the obtained metallic material can cleaned by being degreasing beforehand, if necessary. The method of cleaning the surface is not particularly limited, and a generally used method may be used as the method of cleaning the surface.

The method of manufacturing a metallic material according to the first aspect of the present invention may further include a coating step of providing a ceramic or a resin on the oxide layer of the metallic material, after the oxidation treatment step.

The ceramic or the resin used in the coating step is not particularly limited. For example, a ceramic or a resin that is well-known in the conventional art may be used.

In the coating step, a coating layer can be formed by applying a ceramic or a resin onto the oxide layer of the metallic material and hardening the ceramic or the resin by heating the ceramic or the resin at a temperature of, for example, 150 to 500° C.

In the coating step, a metallic material that includes a coating layer, which is made of a ceramic or a resin and formed on the oxide layer, can be formed by making the coating layer (the layer made of a primer, a curable primer, or an adhesive) adhere to the oxide layer.

A method of manufacturing a metallic material according to a second aspect of the present invention is described below.

The method of manufacturing a metallic material according to the second aspect of the present invention includes: a chemical conversion treatment step of manufacturing the metallic material according to the present invention by making an iron-based metallic material come into contact with an acid aqueous solution that contains metal (A) ions of at least one kind of metal (A) selected from a group consisting of Zr, Ti, and Hf, 30 ppm or more of Fe ions, and oxidant ions.

The iron-based metallic material, which is used in the chemical conversion treatment step of the method of manufacturing a metallic material according to the second aspect of the present invention, is not particularly limited. For example, the same iron-based metallic material may be used as is used in the method of manufacturing a metallic material according to the first aspect of the present invention. Further, a pretreated metallic material may be used as the iron-based metallic material.

The acid aqueous solution that is used in the chemical conversion treatment step of the method of manufacturing a metallic material according to the second aspect of the present invention contains metal (A) ions of at least one kind of metal (A) selected from a group consisting of Zr, Ti, and Hf, 30 ppm or more of Fe ions, and oxidant ions.

As long as the source of supply of Zr ions contained in the acid aqueous solution is a soluble zirconium compound or a zirconium compound that may be dissolved in water when a certain acid component is added thereto, the source of supply of Zr ions is not particularly limited. Examples of the source of supply of Zr include $ZrCl_4$, $ZrOCl_2$, $Zr(SO_4)_2$, $ZrOSO_4$, $Zr(NO_3)_4$, $ZrO(NO_3)_2$, $H_2ZrF_6$, a salt of $H_2ZrF_6$, $ZrO_2$, $ZrOBr_2$, and $ZrF_4$.

As long as the source of supply of Ti ions contained in the acid aqueous solution is a soluble titanium compound or a titanium compound that may be dissolved in water when a certain acid component is added thereto, the source of supply of Ti ions is not particularly limited. Examples of the source of supply of Ti include $TiCl_4$, $Ti(SO_4)_2$, $TiOSO_4$, $Ti(NO_3)$, $TiO(NO_3)_2$, $TiO_2OC_2O_4$, $H_2TiF_6$, a salt of $H_2TiF_6$, $TiO_2$, and $TiF_4$.

As long as the source of supply of Hf ions contained in the acid aqueous solution is a soluble hafnium compound or a hafnium compound that may be dissolved in water when a certain acid component is added thereto, the supply source of Hf ions is not particularly limited. Examples of the source of supply of Hf include $HfCl_4$, $Hf(SO_4)_2$, $Hf(NO_3)$, $HfO_2OC_2O_4$, $H_2HfF_6$, a salt of $H_2HfF_6$, $HfO_2$, and $HfF_4$.

The total concentration of the at least one kind of metal element (A) selected from Zr, Ti, and Hf contained in the acid aqueous solution is in the range of 5 to 5000 ppm and preferably in the range of 10 to 3000 ppm.

Examples of the source of supply of Fe ions contained in the acid aqueous solution include ferric nitrate, iron fluoride, iron citrate, and iron oxalate.

From the standpoint of superior adhesion, electrical conductivity, and heat resistance, the concentration of Fe ions contained in the acid aqueous solution is 30 ppm or higher.

Further, if the concentration of Fe ions contained in the acid aqueous solution is 30 ppm or higher, the metallic material has excellent heat-resistant adhesion.

Furthermore, from the standpoint of superior adhesion and heat-resistant adhesion, the concentration of Fe ions contained in the acid aqueous solution is preferably in the range of 30 to 300 ppm and more preferably in the range of 40 to 150 ppm.

From the standpoint of superior adhesion, heat resistance, corrosion resistance, and electrical conductivity, in the method of manufacturing a metallic material according to the second aspect of the present invention, it is preferable that the acid aqueous solution further contain an amorphous hydroxide of at least one kind of metal (A) selected from a group consisting of Zr, Ti, and Hf.

As long as the amorphous hydroxide of metal (A) is an amorphous material, the amorphous hydroxide is not particularly limited.

Examples of the amorphous hydroxide of metal (A) include $Ti(OH)_2$, $Zr(OH)_2$, and $Hf(OH)_2$.

From the standpoint of increasing the rate of deposition rate of metal (A) and superior corrosion resistance, it is preferable that the amorphous hydroxide of metal (A) has the form of particles.

If particles of metal (A) hydroxides exist in a solution, the acid aqueous solution (treatment solution) is always maintained in a state close to the saturation of metal hydroxides and is maintained in a state in which an oxide layer (film) is most efficiently and stably formed. Because the dissolution or deposition of the particles of the amorphous hydroxide contained in the acid aqueous solution (treatment solution), can be reversibly repeated according to a change of pH or a change of temperature and by the concentration of fluorine ions, it is possible to stably control the treatment bath.

If treatment is performed when particles of amorphous hydroxide do not exist in the bath at all, it is possible that the formation of a film or the amount of deposition becomes unstable or that no deposition at all occurs.

The amount or size of the amorphous hydroxide of metal (A) that exists in the acid aqueous solution (acid solution) is not particularly limited.

From the standpoint of superior adhesion, heat resistance, electrical conductivity, and corrosion resistance, it is preferable that the particle size of the amorphous hydroxide of metal (A) be in the range of approximately 0.02 to 10 μm.

From the standpoint of superior adhesion, heat resistance, electrical conductivity, and corrosion resistance, it is preferable that the number of particles of the amorphous hydroxide of metal (A) be 100/mL or more.

Although the amorphous hydroxide of metal (A) might adhere to a metallic material to be treated, since the amorphous hydroxide is integrated with the deposited film and also has excellent adhesion, performance is not adversely affected by the amorphous hydroxide.

From the standpoint of stable generation of the particles of the amorphous hydroxide of metal (A) and superior corrosion resistance, the pH of the acid aqueous solution is preferably in the range of 3 to 6 and more preferably in the range of 3.5 to 5.5.

Further, from the standpoint of stable generation of the particles of the amorphous hydroxide of metal (A) and superior adhesion, the concentration of Fe ions contained in the acid aqueous solution is preferably in the range of 30 to 150 ppm and more preferably in the range of 40 to 120 ppm.

The particles of the amorphous hydroxide of metal (A) may be obtained by adding ammonia water or a solution of an alkali metal hydroxide, such as NaOH or KOH, to a solution of water-soluble metal salt (which includes, for example, sources of supply Zr ions, Ti ions, and Hf ions) of metal (A) at a low temperature (0 to 40° C.), and agitating the mixed solutions well.

An oxidant is used as a source of supply of the oxidant ions that are contained in the acid aqueous solution.

Examples of an oxidant that may be used include at least one kind of oxygen acid selected from a group consisting of, for example, $HClO_3$, $HBrO_3$, $HNO_2$, $HMnO_4$, $HVO_3$, $H_2O_2$, $H_2WO_4$, and $H_2MoO_4$, or at least one kind of salt selected from salts of these oxygen acids.

An oxygen acid or the salt thereof acts as an oxidant with respect to a metallic material to be treated, and facilitates the deposition of an oxide film.

In this case, it is preferable that the concentration of the oxygen acids or the salts thereof in the acid aqueous solution be in the range of about 10 to 5000 ppm to achieve a sufficient effect.

Among the above, because nitric acid has an oxidizing capability, nitric acid also facilitates the deposition of the oxide layer (oxide film layer). For this reason, nitric acid is one of the most preferable acids. The concentration of the nitric acid contained in the aqueous solution in order to facilitate the deposition of the oxide layer (surface treatment film layer) is preferably in the range of 1,000 to 100,000 ppm and more preferably in the range of 1,000 to 80,000 ppm.

The manufacture of the acid aqueous solution is not particularly limited. For example, a well-known conventional method may be used.

The method of making an iron-based metallic material (the metallic material to be treated) come into contact with an acid aqueous solution is not particularly limited. Examples of the method include a spray treatment for spraying an acid aqueous solution onto the surface of an iron-based metallic material (the metallic material to be treated), a dip treatment for dipping an iron-based metallic material in an acid aqueous solution, and a flow treatment for making an acid aqueous solution flow onto the surface of an iron-based metallic material.

From the standpoint of superior adhesion, the temperature of the acid aqueous solution when the acid aqueous solution and the iron-based metallic material (a metallic material to be treated) come into contact with each other is preferably in the range of 20 to 80° C. and more preferably in the range of 30 to 60° C.

Regardless of what treatment is used, it is possible to form an oxide layer containing Fe and at least one kind of metal (A) selected from Zr, Ti, and Hf as oxides on the surface of the iron-based metallic material (the metallic material to be treated) by making the iron-based metallic material react with the acid aqueous solution by the contact between the iron-based metallic material and the acid aqueous solution.

The method of manufacturing a metallic material according to the second aspect of the present invention may further include an oxidation treatment step of heating the metallic material after the chemical conversion treatment step.

The oxidation treatment step of the method of manufacturing a metallic material according to the second aspect of the present invention has the same meaning as the oxidation treatment step of the method of manufacturing a metallic material according to the first aspect of the present invention.

The method of manufacturing a metallic material according to the second aspect of the present invention may further include a coating step of providing a coating layer that is made of a ceramic or a resin, on the oxide layer of the metallic material, after the oxidation treatment step.

The coating step of the method of manufacturing a metallic material according to the second aspect of the present invention has the same meaning as the coating step of the method of manufacturing a metallic material according to the first aspect of the present invention.

Hereinafter, the combination of the method of manufacturing a metallic material according to the first aspect of the present invention and the method of manufacturing a metallic material according to the second aspect of the present invention will be referred to as a method of manufacturing a metallic material according to the present invention.

The acid aqueous solution usable in the method of manufacturing a metallic material according to the present invention can further contain fluorine.

Fluorine may be mixed in the acid aqueous solution as ions or complex ions. It is preferable that fluorine be added as, for example, a hydrofluoric acid (HF), $H_2ZrF_6$, a salt of $H_2ZrF_6$, $H_2TiF_6$, salt of $H_2TiF_6$, $H_2SiF_6$, salt of $H_2SiF_6$, $HBF_4$, salt of $HBF_4$, $NaHF_2$, $KHF_2$, $NH_4HF_2$, NaF, KF, or $NH_4F$.

It is preferable that the ratio [(B)/(A)] of the molar concentration of fluorine to the molar concentration of metal (A) in the acid aqueous solution be 6 or more.

If the ratio of the molar concentration of fluorine (B) to the molar concentration of metal (A) in the acid aqueous solution is 6 or more, an oxide layer is easily deposited, the stability of the acid aqueous solution is high, and it is difficult for the at least one kind of metal (A) selected from Zr, Ti, and Hf to be deposited in the acid aqueous solution. For this reason, the above-noted ratio of 6 or more is suitable for continuous operation in an actual industrial use.

An acid aqueous solution usable in the method of manufacturing a metallic material according to the present invention can further contain a water-soluble organic compound.

A metallic material, which is obtained by the method of manufacturing a metallic material according to the present invention, exhibits performances, such as sufficient adhesion, heat resistance, and corrosion resistance. However, if addition performance is required, it is possible to modify the properties of the oxide layer by selecting a water-soluble organic compound according to a desired performance and including the selected organic compound in the aqueous solution.

As long as the water-soluble organic compound is an organic compound capable of being dissolved or dispersed in water, the organic compound is not particularly limited. For example, a high molecular compound that is commonly used for the surface treatment of a metal can be used. Specifically, examples of the high molecular compound include polyvinyl alcohol, a poly(meth)acrylic acid, a copolymer of an acrylic acid and a methacrylic acid, a copolymer of ethylene and an acrylic monomer such as a (meth)acrylic acid or a (meth) acrylate, a copolymer of ethylene and vinyl acetate, polyurethane, polyvinylamine, polyallylamine, an amino-modified phenol resin, a polyester resin, an epoxy resin, chitosan and a derivative thereof, tannin, a tannic acid, and salt thereof, and a phytic acid.

Further, it is possible to deposit a water-soluble organic compound layer onto the oxide layer by performing a step of making the oxide layer come into contact with the aqueous solution, which contains the water-soluble organic compound, if necessary, after the metal (A) oxide adhesion step or the chemical conversion treatment step and before the coating step.

From the standpoint of improving heat resistance and adhesion, the acid aqueous solution can further contain an alkaline-earth metal and a rare-earth metal. As one preferred aspect, alkaline-earth metal and rare-earth metal can be added together with a chelating agent such as EDTA.

The acid aqueous solution can further contain an additive. Examples of the additive include a surfactant and an organic inhibitor.

The pH of the acid aqueous solution is preferably in the range of 2 to 6 and more preferably in the range of 3 to 5.

In order to adjust pH of the aqueous solution to the alkali side, an alkali metal hydroxide, for example, such as a sodium hydroxide or a potassium hydroxide, a hydroxide or an oxide of alkaline-earth metal, ammonia, or an alkali component such as an amine compound can be used as a pH regulator.

In order to adjust pH of the aqueous solution to the acid side, one or more kinds of inorganic acids such, as a nitric acid, a sulfuric acid, and a hydrochloric acid, and/or one or more kinds of organic acids, such as an acetic acid, an oxalic acid, a tartaric acid, a citric acid, a succinic acid, a gluconic acid, or a phthalic acid may be used as a pH regulator.

The acid aqueous solution can further contain a surfactant, such as a nonionic surfactant, an anionic surfactant, or a cationic surfactant. In this case, it is possible to simultaneously perform degreasing treatment and deposition of the oxide layer (oxide film layer) by making an iron-based metallic material (a metallic material to be treated) which was not priorly subjected to degreasing treatment and to which oil adheres, come into contact with the aqueous solution that contains at least one kind of surfactant selected from a group consisting of the above-noted surfactants.

According to the method of manufacturing a metallic material of the present invention, it may be possible to manufacture a metallic material that includes a single oxide layer or multiple oxide layers.

If the method of manufacturing a metallic material according to the present invention includes an oxidation treatment step, it is possible to manufacture a metallic material that includes multiple oxide layers.

EMBODIMENTS

The present invention is specifically described below with reference to the following embodiments. However, the present invention is not limited to these embodiments.

1. Preparation of the Test Plate (Metallic Material)

In a test, a stainless steel plate (SUS430) of 70×150 mm (thickness: 0.8 mm) and a cold-roiled steel plate (SPC) were used as a base material of a metallic material (iron-based metallic material).

(Pre-Processing)

The steel plate used in the test was degreased with an alkaline degreasing solution (FC-4360 20 g/L, manufactured by Nihon Parkerizing Co., Ltd.) for 120 seconds at a temperature of 60° C., and was then rinsed with water.

SUS430 that had been subjected to surface roughening treatment using an etchant (which was obtained by adding 10 g/L of a hydrochloric acid to 100 g/L of ferric chloride) for 3 minutes at a temperature of 40° C., after which a film was then peeled off by using a nitric acid of 20%, was used as the base materials of metallic materials of Example 6 and Comparative example 2.

Further, an aqueous solution was prepared that was obtained by diluting a manganese phosphate-based surface treating agent (PALFOS M1A, manufactured by Nihon Parkerizing Co., Ltd.) with water at a concentration of 14 mass %, adjusting the total acidity, the acid ratio (total acidity/free acidity), and the iron concentration to the standard concentration of the catalog value, and heating the diluted surface treating agent up to a temperature of 96° C., and them perform film chemical conversion treatment of SPC using the aqueous solution and a surface roughening treatment by peeling off a film for 5 minutes with a hydrochloric acid of 5%, the result being used as the base materials of metallic materials of embodiments 4 and 10 and of Comparative example 1.

(Formation of the Oxide Layer)

An oxide layer was formed by the following method.

Embodiment 1

An aqueous solution, which was obtained by diluting titanium chloride with water to a concentration of 50%, was further diluted approximately 10 times and was made mildly alkaline by adding ammonia water thereto, thereby causing precipitation of titanium hydroxide. The precipitate was rinsed well with deionized water and then dissolved in hydrogen peroxide water, so as to prepare a peroxotitanic acid solution of 1.3%.

A metallic material was obtained by dip-coating this solution onto a test plate made of SUS430 (metal (A) oxide adhesion step) and baking the test plate for 60 minutes at a temperature of 400° C. (oxidation treatment step).

The amount of $TiO_2$ adhering to the obtained metallic material, which was measured by an X-ray fluorescence spectrometer (SYSTEM 3270, manufactured by Rigaku Industrial Corp., similar hereinafter), was 160 mg/m$^2$. Further, $\gamma$-$Fe_2O_3$ was detected from the oxide layer (film layer) of the obtained metallic material by X-ray diffraction (performed using an X-ray diffractometer (X'PERT-MRD, manufactured by Philips Electronics), similar hereinafter).

Embodiment 2

A coating solution was prepared that was obtained by diluting a zirconium carbonate solution (20 mass % as $ZrO_2$) with water to 2 mass %.

A metallic material was obtained by dip-coating this solution onto an SPC plate made and drying the test plate for 20 minutes at a temperature of 180° C.

The amount of $ZrO_2$ adhering to the obtained metallic material, which was measured by an X-ray fluorescence spectrometer, was 220 mg/m$^2$. Further, $\gamma$-$Fe_2O_3$ was detected from the oxide layer (film layer) of the obtained metallic material by X-ray diffraction. Furthermore, $\gamma$-$Fe_2O_3$ was detected at a boundary portion between the base material and a Zr oxide film by TEM observation of the cross-section of the obtained metallic material.

Embodiment 3

A coating solution was prepared that was obtained by diluting a solution, which was obtained by adding 1/10 mol of oxalic acid hafnium to a zirconium carbonate solution (20 mass % as $ZrO_2$), with water to 2 mass %.

A metallic material was obtained by dip-coating this solution onto an SPC test plate and drying the test plate for 20 minutes at a temperature of 180° C.

The amount of $ZrO_2$ adhering to the obtained metallic material, which was measured by an X-ray fluorescence spectrometer, was 220 mg/m$^2$. Further, $\gamma$-$Fe_2O_3$ was detected from the oxide layer (film layer) of the obtained metallic material by X-ray diffraction. Furthermore, $\gamma$-$Fe_2O_3$ was detected at a boundary portion between the base material and a Zr—Hf oxide film from the TEM observation of the cross-section of the obtained metallic material.

Embodiment 4

A coating solution was prepared that was obtained by diluting a zirconium carbonate solution (20 mass % as $ZrO_2$) with water to 2 mass %.

A metallic material was obtained by dip-coating this solution onto an SPC test plate, the surface of which had been roughened by peeling-off using manganese phosphate-hydrochloric acid, and drying the test plate for 20 minutes at a temperature of 180° C.

The amount of $ZrO_2$ adhering to the obtained metallic material, which was measured by an X-ray fluorescence spectrometer, was 270 mg/m$^2$. Further, $\gamma$-$Fe_2O_3$ was detected from the oxide layer (film layer) of the obtained metallic material by X-ray diffraction.

Embodiment 5

The peroxotitanic acid solution of 1.3%, which was used in Embodiment 1, was diluted two times with water and put into an electrolytic bath. Then, with platinum-plated titanium plates used as opposing electrodes, anode electrolysis was performed on the test plate made of SUS430 for 60 seconds at a voltage of 15 V. The deposition of peroxotitanic acid gel was observed on the test plate after anode electrolysis had been performed.

A titanium oxide film was formed by baking the test plate for 60 minutes at a temperature of 450° C. after drying the test plate after the anode electrolysis, thereby obtaining the metallic material.

The amount of $TiO_2$ adhering to the obtained metallic material, which was measured by an X-ray fluorescence spectrometer, was found to be 330 mg/m$^2$. Further, $\gamma$-$Fe_2O_3$ was detected from the oxide layer (film layer) of the obtained metallic material by X-ray diffraction.

Embodiment 6

A chemical conversion treatment solution having a Ti concentration of 1500 ppm, a Fe concentration of 50 ppm, an aluminum concentration of 300 ppm, and a citric acid concentration of 50 ppm, was prepared using a hexafluorotitanic acid (IV) aqueous solution, ferric nitrate, a nitric acid aluminum solution, a citric acid, and a hydrofluoric acid. Then, after the aqueous solution was heated to a temperature of 55° C., the aqueous solution was adjusted with ammonia water so as to have a pH of 2.5, thereby preparing the chemical conversion treatment solution.

The chemical conversion treatment solution was sampled and observed using a microscope, the result being that particles of a hydroxide were not observed in the treatment solution.

A metallic material was obtained by using this chemical conversion treatment solution in the chemical conversion treatment step, and performing a reaction treatment for 120 seconds by dipping a test plate made of SUS430, the surface of which had been roughened in a ferric chloride etchant.

The amount of $TiO_2$ adhering to the obtained metallic material, which was measured by an X-ray fluorescence spectrometer, was 80 mg/m$^2$.

After the chemical conversion treatment step, the metallic material was baked for 60 minutes at a temperature of 450° C. in the oxidation treatment step. $\gamma$-$Fe_2O_3$ was detected by X-ray diffraction from the oxide layer (film layer) of the metallic material that was obtained after the oxidation treatment step.

Embodiment 7

A chemical conversion treatment solution having a zirconium concentration of 5 ppm and a Fe concentration of 35 ppm, was prepared using zirconium oxynitrate, ferric nitrate, and hydrochloric acid. Then, after the aqueous solution was heated to a temperature of 45° C., the aqueous solution was adjusted with ammonia water so as to have a pH of 4.8, thereby preparing the chemical conversion treatment solution. The chemical conversion treatment solution was sampled and observed using a microscope, the result of which was that transparent particles of zirconium hydroxide, having a particle size in the range of 5 to 30 μm were observed in the entire treatment solution.

A metallic material was obtained by using this chemical conversion treatment solution in the chemical conversion treatment step, and performing a reaction treatment for 120 seconds by dipping the SPC test plate.

The amount of $ZrO_2$ adhering to the obtained metallic material, which was measured by an X-ray fluorescence spectrometer, was 180 mg/m$^2$.

After the chemical conversion treatment step, the metallic material was baked for 30 minutes at a temperature of 250° C. in the oxidation treatment step.

$\gamma$-$Fe_2O_3$ was detected by X-ray diffraction from the oxide layer (film layer) of the metallic material that was obtained after the oxidation treatment step.

Embodiment 8

A chemical conversion treatment solution having a zirconium concentration of 5 ppm, a Fe concentration of 80 ppm, and a magnesium concentration of 300 ppm, was prepared using zirconium oxynitrate, ferric nitrate, a magnesium nitrate solution, and hydrochloric acid. Then, after the aqueous solution was heated to a temperature of 45° C., the aqueous solution was adjusted with ammonia water so as to have a pH of 4.4, thereby preparing the chemical conversion treatment solution. The chemical conversion treatment solution was sampled and observed using a microscope, the result being that transparent particles of zirconium hydroxide having a particle size in the range of 1 to 20 μm were observed in the entire treatment solution.

A metallic material was obtained by using this chemical conversion treatment solution in the chemical conversion treatment step and performing a reaction treatment for 120 seconds by dipping the test plate made of SPC.

The amount of $ZrO_2$ adhering to the obtained metallic material, which was measured by an X-ray fluorescence spectrometer, was 210 mg/m$^2$.

After the chemical conversion treatment step, the metallic material was baked for 30 minutes at a temperature of 250° C. in the oxidation treatment step.

$\gamma$-$Fe_2O_3$ was detected by X-ray diffraction from the oxide layer (film layer) of the metallic material that was obtained after the oxidation treatment step.

To confirm the structure of the cross-section of the oxide layer (film) of the metallic material of Embodiment 8, a photograph of the cross-section of the metallic material obtained in Embodiment 8 was taken by a transmission-type electron microscope (magnification: x100000, H-9000, manufactured by Hitachi, Ltd.), the result being shown in FIG. 1.

FIG. 1 is a photograph of a cross-section of an example of a metallic material according to the present invention that was taken by a transmission-type electron microscope.

As is apparent from the result shown in FIG. It and the result obtained by EDS analysis and the like, in FIG. 1, it was possible to confirm that the metallic material 1 includes an oxide layer 3 on the surface of an iron-based metallic material 2, the oxide layer 3 including upper and lower layers 4 and 5, the lower layer 5 being made of an iron oxide, and the upper layer 4 being made of a zirconium oxide.

Further, the iron oxide of the lower layer 5 was a crystalline iron oxide.

From the result shown in FIG. 1, it was possible to confirm that the upper layer 4 was a metal (A) oxide having a thickness of 0.2 to 0.3 μm and that the lower layer 5 was an iron oxide having a thickness of 0.02 to 0.15 μm.

As apparent from the result shown in FIG. 1, because the lower layer 5 forms minute concavities and convexities on the surface of the iron-based metallic material 2 (see FIG. 1), adhesion between the upper and lower layers 4 and 5 becomes excellent by an anchor effect that is caused by the minute concavities and convexities of the lower layer 5.

Embodiment 9

A chemical conversion treatment solution having a zirconium concentration of 5 ppm, a magnesium concentration of 300 ppm, an ascorbic acid concentration of 50 ppm, and a Fe concentration of 40 ppm, was prepared using a zirconium oxynitrate solution, a nitric acid magnesium solution, ferric nitrate, and a hydrofluoric acid reagent. Then, after a 50 ppm polyallylamine aqueous solution (PAA-05, manufactured by Nitto Boseki Co., Ltd.) was added to the aqueous solution and the aqueous solution was heated to a temperature of 50° C., the aqueous solution was adjusted with an ammonia water reagent so as to have a pH of 4.5, thereby preparing the chemical conversion treatment solution. The chemical conversion treatment solution was sampled and observed using a microscope, the result being that transparent particles of a zirconium hydroxide having a particle size in the range of 1 to 20 μm were observed in the entire treatment solution. Confirmation of whether the particles were zirconium hydroxide was performed by filtering the treatment solution by a microfilter, washing the treatment solution with water, and confirming the dried material using a fluorescence X-ray method.

A metallic material was obtained by using this chemical conversion treatment solution in the chemical conversion treatment step and performing a reaction treatment for 120 seconds by dipping the SPC test plate.

The amount of $ZrO_2$ adhering to the obtained metallic material, which was measured by an X-ray fluorescence spectrometer, was 180 mg/m$^2$.

After the chemical conversion treatment step, the metallic material was baked for 30 minutes at a temperature of 250° C. in the oxidation treatment step. $\gamma$-$Fe_2O_3$ was detected by X-ray diffraction from the oxide layer (film layer) of the metallic material that was obtained after the oxidation treatment step.

Embodiment 10

A chemical conversion treatment solution having a zirconium concentration of 200 ppm, a titanium concentration of 50 ppm, a citric acid concentration of 100 ppm, a Fe concentration of 80 ppm, and a magnesium concentration of 14000 ppm, was prepared using a hexafluorozirconate (IV) aqueous solution, a hexafluorotitanic acid (IV) aqueous solution, ferric nitrate, a citric acid, and a nitric acid magnesium solution. Then, after 50 ppm of a diallylamine copolymer aqueous solution (PAS-92, manufactured by Nitto Boseki Co., Ltd.) was added to the aqueous solution and the aqueous solution was heated to a temperature of 50° C., the aqueous solution was adjusted with an ammonia water reagent so as to have a pH of 4.5, thereby preparing the chemical conversion treatment solution. The chemical conversion treatment solution was sampled and observed using a microscope, the result being that transparent particles of zirconium hydroxide having a particle size in the range of 1 to 20 μm were observed in the entire treatment solution. Confirmation of whether the particles were zirconium hydroxide was performed by filtering the treatment solution by a microfilter, washing the treatment solution with water, and confirming a dried material by a fluorescence X-ray method.

A metallic material was obtained by using this chemical conversion treatment solution in the chemical conversion treatment step and performing a reaction treatment for 120 seconds by dipping the SPC test plate, the surface of which had been roughened by peeling off using manganese phosphate-hydrochloric acid.

The amounts of $ZrO_2$ and $TiO_2$ adhering to the obtained metallic material were measured by an X-ray fluorescence spectrometer. The amount of adhering $ZrO_2$ was 170 mg/m$^2$ and the amount of adhering $TiO_2$ was 130 mg/m$^2$.

After the chemical conversion treatment step, the metallic material was baked for 30 minutes at a temperature of 180° C. in the oxidation treatment step.

$\gamma$-$Fe_2O_3$ was detected by X-ray diffraction from the oxide layer (film layer) of the metallic material that was obtained after the oxidation treatment step.

Comparative Example 1

Film chemical conversion treatment was performed on the SPC test plate, which was degreased in the same manner as in the embodiments, with an aqueous solution that was obtained by diluting a manganese phosphate-based surface treating agent (PALFOS M1A, manufactured by Nihon Parkerizing Co., Ltd.) with water to a concentration of 14 mass %, adjusting total acidity, the acid ratio (total acidity/free acidity), and iron concentration to the standard concentration of the catalog value, and heating the diluted surface treating agent up to a temperature of 96° C. Then, the test plate, was subjected to peeling off a film for 5 minutes with a hydrochloric acid of 5%, the result being used as the metallic material.

Comparative Example 2

A test plate made of SUS430 was subjected to surface roughening and degreasing, in the same manner as that in the embodiments, for 3 minutes at a temperature of 40° C. with an etchant that was obtained by adding 10 g/L of hydrochloric acid to 100 g/L of ferric chloride. Then, the test plate was subjected to peeling off a film for 10 minutes with nitric acid of 20%, the result being used as the metallic material.

Comparative Example 3

An aqueous solution obtained by diluting a manganese phosphate-based surface treating agent (PALFOS M1A, manufactured by Nihon Parkerizing Co., Ltd.) with water to a concentration of 14 mass %, adjusting the total acidity, the acid ratio (total acidity/free acidity), and the iron concentration to the center value of the catalog, and heating the diluted surface treating agent to a temperature of 96° C., the result being used as the surface treatment solution.

The surface treatment film layer was deposited by dipping a carbon steel round bar (abbreviation S45C: JIS G 4051, 10-mm diameter×35 mm, surface roughness Rz JIS 2 μm), which was rinsed with water after being degreased, into the surface treatment solution for 120 seconds. Then, water rinsing, ion-exchanged water rinsing, and drying were performed, and the surface treatment solution and water remaining on the surface of the carbon steel round bar were removed.

Comparative Example 4

A coating solution was prepared that was obtained by diluting a zirconium carbonate solution (20 mass % as $ZrO_2$) with water to 2 mass %. A metallic material was obtained by dip-coating this solution onto a test plate made of SUS430 and drying the test plate for 20 minutes at a temperature of 30° C.

The amount of $ZrO_2$ adhering to the obtained metallic material, which was measured by an X-ray fluorescence spectrometer, was 220 mg/m$^2$. Further, an Fe oxide was not detected from the oxide layer (film layer) of the obtained metallic material by X-ray diffraction and XPS Comparative Example 5

A chemical conversion treatment solution having a zirconium concentration of 5 ppm and a magnesium concentration of 300 ppm was prepared using zirconium oxynitrate, a magnesium nitrate solution, and hydrofluoric acid. Then, after the aqueous solution was heated to a temperature of 45° C., the aqueous solution was adjusted with an ammonia water reagent so as to have a pH of 3.0, thereby preparing the chemical conversion treatment solution. The chemical conversion treatment solution was sampled and observed using a microscope, the result of which was that particles of a zirconium hydroxide were not observed in the treatment solution.

A metallic material was obtained by using this chemical conversion treatment solution in the chemical conversion treatment step, and performing a reaction treatment for 120 seconds by dipping of the SPC test plate.

The amount of $ZrO_2$ adhering to the obtained metallic material, which was measured by an X-ray fluorescence spectrometer, was 110 mg/m$^2$.

After the chemical conversion treatment step, the metallic material was baked for 10 minutes at a temperature of 60° C. in the oxidation treatment step. An Fe oxide was not detected from the oxide layer (film layer) of the obtained metallic material, on which the oxidation treatment step has been performed, by either X-ray diffraction and XPS.

2. Analysis of the Properties of the Oxide Layer (Surface Treatment Film Layer)

The amount of Fe contained in the oxide layer, the amount of adhering metal (A), and the structure of the oxide contained in the oxide layer were analyzed by the following methods.

The results of the amount of Fe contained in the oxide layer and the amount of adhering metal (A) are shown in Table 1.

The results of the amount of adhering metal (A) and the structure of the oxide contained in the oxide layer have been described in the respective embodiments.

(1) Measurement of the Amount of Metal (A) Adhering to Oxide Layer (Surface Treatment Film Layer)

The amount of metal (A) adhering to the oxide layer (surface treatment film layer) was measured by an X-ray fluorescence spectrometer (SYSTEM 3270, manufactured by Rigaku Industrial Corp.).

(2) Structural Analysis of the Oxide of the Oxide Layer (Surface Treatment Film Layer)

The structure of the oxide was analyzed by analyzing the oxide layer (surface treatment film layer) of the metallic material, which was obtained in the examples, using an X-ray diffractometer (X'PERT-MRD, manufactured by Philips Electronics) by a thin-film analysis method (incident angle of 0.5°).

(3) The Amount of Fe Contained in the Oxide Layer

The amount of Fe contained in the oxide layer of the metallic material obtained in the examples, was measured at each depth of the film with an XPS analysis apparatus ESCA, which was manufactured by Shimadzu Corporation, by surface analysis using XPS (X-ray photoelectron spectroscopy).

Figure 3:
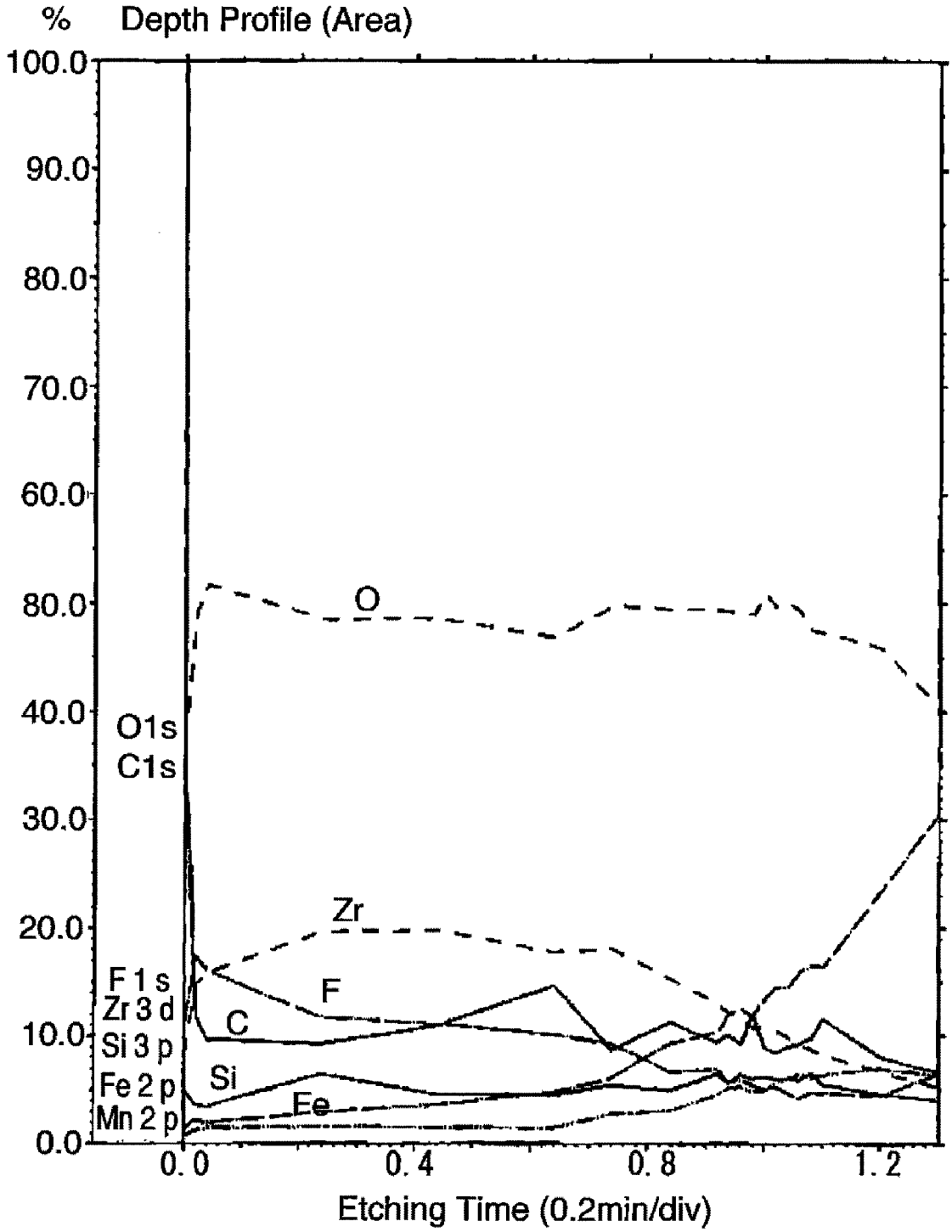
FIG. 3 is a graph showing the amount of each element (unit: atom %) as a depth profile, the amount of each element being obtained from the result of an analysis performed using XPS (X-ray photoelectron spectroscopy) of each element contained in an oxide layer of an example of the metallic material according to the present invention.

The results of the surface analysis of the oxide layer of the metallic material, which were obtained in Example 8 using XPS (X-ray photoelectron spectroscopy) are shown in the accompanying drawings (FIG. 2 and FIG. 3).

FIG. 2 is a series of graphs showing the XPS narrow spectra obtained from the results of the analysis of each element contained in an oxide layer of an example of the metallic material according to the present invention, which was performed using XPS (X-ray photoelectron spectroscopy).

FIG. 3 is a graph showing the amount of each element (unit: atom %) as a depth profile, the amount of each element being obtained from the results of the analysis of each element contained in an oxide layer of an example of the metallic material according to the present invention, which was performed using XPS (X-ray photoelectron spectroscopy).

A depth profile shown in FIG. 3 was drawn on the basis of data of the XPS narrow spectrum shown in FIG. 2.

The surface analysis of the oxide layer of the metallic material, which was obtained for Embodiment 8 using XPS (X-ray photoelectron spectroscopy), was performed toward the lower layer while sputtering was performed from the outermost surface.

In FIG. 3, the average percentages of the respective elements after the beginning of analysis until the atomic percent of oxygen of oxide layer becomes less than 40% (that is, until the sputtering reaches the iron-based metallic material), were shown as the content of the respective elements in the oxide layer.

As is apparent from the results shown in FIG. 3, the average atomic percentage of Fe (the content of Fe in the oxide layer) in the upper layer of the oxide layer was different from that in the lower layer.

That is, in FIG. 3, the atomic percent of Fe at an etching time of 0.2 minute was 3 atom %. The oxide layer portion at an etching time of 0.2 minutes corresponds to the upper layer.

Further, in FIG. 3, the atomic percentage of Fe at an etching time of 1.2 minutes was approximately 20 atom %. The oxide layer portion at an etching time of 1.2 minutes corresponds to the lower layer.

Although the boundary between the upper and lower layers was not clear, the average percentage of Fe in the oxide layer, including the upper and lower layers, was 8.2 atom %.

The average Fe content of the oxide layer in the depth direction was in the range of 2 to 30 atom % in all examples.

3. Evaluation of the Performance of the Oxide Layer (Film)

The contact resistance, corrosion resistance, adhesion, and heat-resistant adhesion of the obtained metallic material were tested by the following methods, and were evaluated on the basis of evaluation criteria indicated below. The results of the evaluation are shown in Table 1.

(Contact Resistance)

With regard to the treated test plate made of SPC and the treated test plate made of SUS430, the contact resistance of the obtained metallic material was measured by a surface resistance meter (MCP-T360 type [two-point type, using a standard probe] manufactured by Mitsubishi Chemical Corporation).

(Corrosion Resistance Test)

The treated test plate made of SPC and the treated test plate made of SUS430 were tested for 1000 hours by a salt spray test method (JIS Z 2371), and the degree of rust generated after testing was evaluated on the basis of the following criteria.

5: Generation of rust is not seen

4: Area of rust is less than 1%

3: Area of rust is equal to or greater than 1% and less than 5%

2: Area of rust is equal to or greater than 5% and less than 20%

1: Area of rust is equal to or greater than 20%

(Adhesion Test)

About 100 g/m$^2$ of a two-part type epoxy adhesive (High Super-5, manufactured by Cemedine Co., Ltd.), which was obtained by sufficiently mixing liquid A and liquid B at a ratio of 1:1, was applied to the surfaces of the treated test plate made of SPC and the treated test plate made of SUS430, and was left for 24 hours. Further, the test plate made of SPC or the test plate made of SUS430, to which the adhesive was applied, were dipped in the NaOH aqueous solution of 5%, which was heated up to 60° C., for 60 minutes, were rinsed with water, and were dried. Then, one end of the test plate was fixed held in a vice, and the test plates were bent to an angle of 90° so that the surfaces of the test plates to which the adhesive was applied faced the outside. The peeling condition of the bent portion was evaluated as follows:

5: No peeling

4: No peeling, with cracking

3: Peeling less than 20% and cracking

2: Peeling equal to or greater than 20% and less than 20%, and with large cracking 1: Peeling equal to or larger than 50%

(Heat-Resistant Adhesion Test)

About 100 g/m$^2$ of a heat-resistant conductive inorganic adhesive (Resbond 954, manufactured by Cotronics Corp.) was applied to the surfaces of the treated test plate made of SPC and the treated test plate made of SUS430, followed by drying at room temperature. The plates were then oxidized in the atmosphere for two hours at a high temperature of 1000° C. in an electric furnace. After the tested plates were cooled to room temperature, whether peeling occurred was evaluated by attaching an adhesive tape to the tested plated and detaching the adhesive tap from the tested plated.

5: No peeling

4: Peeling equal to or less than 1%

3: Peeling equal to or greater than 1% and less than 5%

2: Peeling equal to or greater than 5% and less than 30%

1: Peeling equal to or greater than 30%

TABLE 1

| | Ease material (iron-based metallic material) | Metal (A) | The amount of Fe in oxide layer (unit: atom %) | The amount of adhering metal (A) (unit expressed in terms of $AO_2$: mg/m$^2$) | Corrosion resistance | Adhesion | Heat-resistant adhesion | Contact resistance (Ω) |
|---|---|---|---|---|---|---|---|---|
| Embodiment 1 | SUS | Ti | 3.5 | 160 | 5 | 4 | 4 | 25 |
| Embodiment 2 | SPC | Zr | 6.0 | 220 | 4 | 4 | — | 47 |
| Embodiment 3 | SPC | Zr + Hf | 4.7 | $ZrO_2$: 220<br>$HfO_2$: 10 | 4 | 5 | — | 38 |
| Embodiment 4 | SPC | Zr | 7.3 | 270 | 4 | 5 | — | 52 |
| Embodiment 5 | SUS | Ti | 5.5 | 330 | 5 | 5 | 5 | 120 |
| Embodiment 6 | SUS | Ti | 4.2 | 80 | 5 | 5 | 4 | 16 |
| Embodiment 7 | SPC | Zr | 6.3 | 180 | 4 | 5 | — | 32 |
| Embodiment 8 | SPC | Zr | 8.2 | 210 | 4 | 5 | — | 68 |
| Embodiment 9 | SPC | Zr | 13.5 | 180 | 4 | 5 | — | 155 |

TABLE 1-continued

| | Ease material (iron-based metallic material) | Metal (A) | The amount of Fe in oxide layer (unit: atom %) | The amount of adhering metal (A) (unit expressed in terms of $AO_2$: mg/m$^2$) | Corrosion resistance | Adhesion | Heat-resistant adhesion | Contact resistance (Ω) |
|---|---|---|---|---|---|---|---|---|
| Embodiment 10 | SPC | Zr + Ti | 5.3 | $ZrO_2$: 170 + $TiO_2$: 130 | 4 | 5 | — | 31 |
| Comparative Example 1 | SPC | — | 5.7 | — | — | 3 | — | >1000 |
| Comparative Example 2 | SUS | — | — | — | 1 | 3 | 3 | 40 |
| Comparative Example 3 | SPC (Carbon steel round bar) | — | 4.8 | — | — | 3 | — | >1000 |
| Comparative Example 4 | SUS | Zr | — | 220 | 2 | 3 | 3 | 360 |
| Comparative Example 5 | SPC | Zr | — | 110 | — | 3 | — | 240 |

As is apparent from the results shown in Table 1, the corrosion resistance, electrical conductivity, adhesion, and heat resistance (heat-resistant adhesion) of embodiments 1 to 10 were superior to those of Comparative Examples 1 to 5 in the related conventional art, and the effect of the present invention is clear.

The invention claimed is:

1. A method of manufacturing a metallic material, the method comprising:

a chemical conversion treatment step of manufacturing a metallic material comprising: an iron-based metallic material; an oxide layer that is formed on the surface of the iron-based metallic material, wherein the oxide layer includes Fe and at least one kind of metal (A) selected from a group consisting of Zr, Ti, and Hf by making an iron-based metallic material come into contact with an acid aqueous solution that includes:

metal (A) ions of at least one kind of metal (A) selected from a group consisting of Zr, Ti, and Hf, 30 ppm or more of Fe ions, and oxidant ions; and an oxidation treatment step, after the chemical conversion treatment step, of heating the metallic material wherein oxidation takes place at a temperature of 400° C. or more.

2. The method according to claim 1, wherein the oxide layer is formed such that said oxide layer includes an upper layer that includes a metal (A) oxide of at least one kind of metal (A) selected from a group consisting of Zr, Ti, and Hf, and a lower layer that includes at least an iron oxide.

3. The method according to claim 2, wherein the lower layer has a thickness in a range of 0.02 to 0.5 μm.

4. The method according to claim 1, wherein the oxide includes at least one kind of iron oxide selected from a group consisting of γ-$Fe_2O_3$, α-$Fe_2O_3$, and $Fe_3O_4$.

5. The method according to claim 1, wherein the oxide layer includes 2 to 30 atom % of Fe.

6. The method according to claim 1, wherein the metal (A) included in the oxide layer is present in an amount ranging from 10 to 1000 mg/m$^2$ as the total amount expressed in terms of $AO_2$.

7. The method according to claim 1, wherein the oxide layer has a contact resistance of 200Ω or less.

8. The method according to claim 1, further comprising:

a coating step whereby a coating layer is formed on the oxide layer and is made of a ceramic or a resin.

9. The method according to claim 1, wherein heating temperature in the oxidation treatment step is in a range of 450° C. to 700° C.

10. The method according to claim 9, further comprising:

a coating step, after the oxidation treatment step, of providing a coating layer, which is made of a ceramic or a resin, on the oxide layer of the metallic material.

11. The method according to claim 9, wherein the iron-based metallic material is stainless steel.

12. The method according to claim 1, wherein the acid aqueous solution further includes fluorine.

13. The method according to claim 1, wherein the acid aqueous solution further includes a water-soluble organic compound.

14. The method according to claim 1, wherein the acid aqueous solution further includes an amorphous hydroxide of at least one kind of metal (A) selected from a group consisting of Zr, Ti, and Hf.

* * * * *